US007329209B2

(12) United States Patent
Lo

(10) Patent No.: US 7,329,209 B2
(45) Date of Patent: Feb. 12, 2008

(54) BELT FRAME INCLINE ADJUSTING MECHANISM FOR TREADMILLS

(76) Inventor: Chiu-Hsiang Lo, No. 20, Lane 305, Sec. 3, Chung-Sun Rd., Tan-Tz Shiang, Taichung Hsien (TW)

( * ) Notice: Subject to any disclaimer, the term of this patent is extended or adjusted under 35 U.S.C. 154(b) by 408 days.

(21) Appl. No.: 11/155,489

(22) Filed: Jun. 20, 2005

(65) Prior Publication Data

US 2006/0199704 A1 Sep. 7, 2006

(30) Foreign Application Priority Data

Mar. 4, 2005 (TW) ..... 94203417 U

(51) Int. Cl.
*A63B 22/00* (2006.01)

(52) U.S. Cl. ..... 482/54

(58) Field of Classification Search ..... 482/51, 482/54

See application file for complete search history.

(56) References Cited

U.S. PATENT DOCUMENTS 5,967,945 A * 10/1999 Wang ..... 482/54
6,726,602 B2 * 4/2004 Chang ..... 482/54
6,811,518 B2 * 11/2004 Lin ..... 482/54
6,884,201 B2 * 4/2005 Wu ..... 482/54
6,923,747 B1 * 8/2005 Chu ..... 482/54

* cited by examiner

*Primary Examiner*—Stephen R. Crow
(74) *Attorney, Agent, or Firm*—WPAT, P.C.; Anthony King

(57) ABSTRACT

A treadmill includes a base with two side rails, a frame with two side rods and an endless running belt, two first links, two second links, two third links, a fixing rod which is fixed in-between the two first links with a connection and an actuator is composed of a motor and a motor driven moving part which is pivotally connected to the connection of the fixing rod. Each group of the first links, the second links, the third links and the side rail is structured as a four-bar-link mechanism, which is working to bring up or down the first end of the frame when the actuator is driving the moving part, incline angle of the frame is changing, the purpose of adjusting the inclination of the frame and even folding the frame is simply and efficiently achieved.

7 Claims, 8 Drawing Sheets

BELT FRAME INCLINE ADJUSTING MECHANISM FOR TREADMILLS

FIELD OF THE INVENTION

The present invention relates to a mechanism for adjusting the belt frame incline angle of a treadmill.

BACKGROUND OF THE INVENTION

A conventional treadmill shown in FIG. 9 generally includes a base 80, a frame 81 that has one pivotal end connected to the base and an endless running belt 82 is mounted to the frame. The endless running belt can also be driven by a motor so that the users can set desired running speed to exercise.

Some conventional treadmills are equipped with incline adjusting mechanisms, which link driving devices on the frames. The driving device drives the end of the frame up and down to reach the purpose of adjusting the inclination of the frame. But the incline adjusting mechanism can only adjust the inclination of the frame and unable to fold the frame.

In order to save space occupied by the treadmill, some treadmills are equipped with folding devices shown in FIG. 9, which allow the frame to be pivotally related to the base. U.S. Pat. No. 6,527,679 discloses a folding mechanism, which uses a motor and a threaded rod that is driven by the motor and a connection member pivotally connected to the frame is movably mounted to the threaded rod so that when the threaded rod is rotated by the motor, the connection member pivots the frame. It is noted that the folding mechanism can only fold the frame but unable to adjust the inclination of the frame.

SUMMARY OF THE INVENTION

The present invention relates to a treadmill with mechanisms, which can adjust the inclination of the frame and fold the frame simply and efficiently. The treadmill comprises a base with two side rails, each side rail has a first pivotal point and a second pivotal point; a frame with two side rods, each rod has a pivotal point near the first end of the frame; an endless running belt is mounted to the frame; two first links, each has a first pivotal point, a second pivotal point and a third pivotal point, the third pivotal point is pivotally connected to the pivotal point on the side rod of the frame; two second links, the first end of each of the two second links is respectively pivotally connected to the first pivotal point on each of the two side rails of the base and the second end is respectively pivotally connected to the first pivotal point of each of the two first links; two third links, the first end of each of the two third links is respectively pivotally connected to the second pivotal point on each of the two side rails of the base and the second end is respectively pivotally connected to the second pivotal point of each of the two first links; a fixing rod which is fixed in-between the two first links with a connection and an actuator composed of a motor and a motor driven moving part which is pivotally connected to the connection of the fixing rod. Each group of the first link, the second link, the third link and side rail is structured as a four-bar-link mechanism, which is working to bring up or down the first end of the frame when the actuator is driving the moving part, incline angle of the frame is changing, the purpose of adjusting the inclination of the frame and even folding the frame is simply and efficiently achieved.

BRIEF DESCRIPTION OF THE DRAWINGS

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
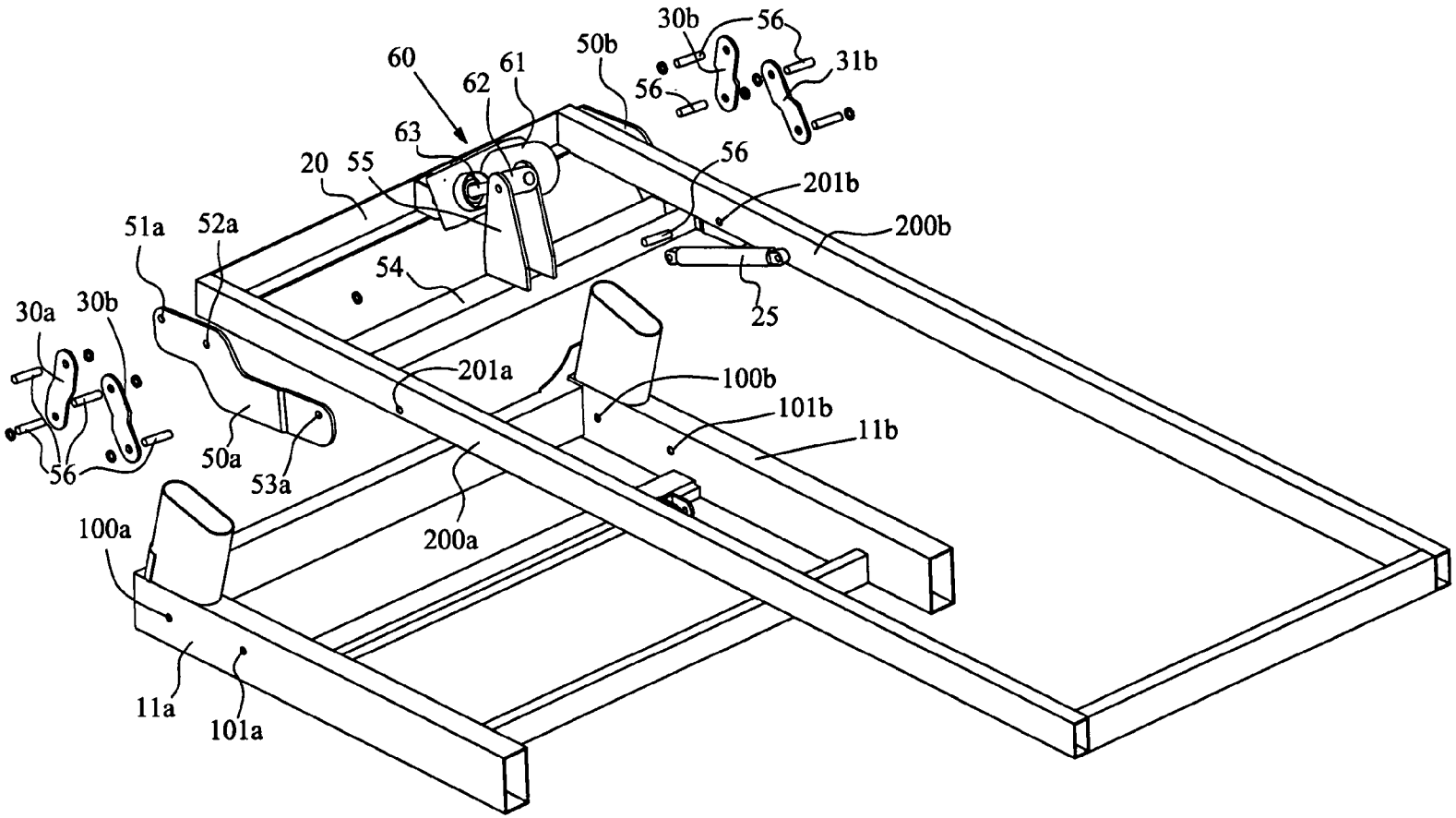
FIG. 1 is an exploded view of the treadmill of the present invention.
Figure 2:
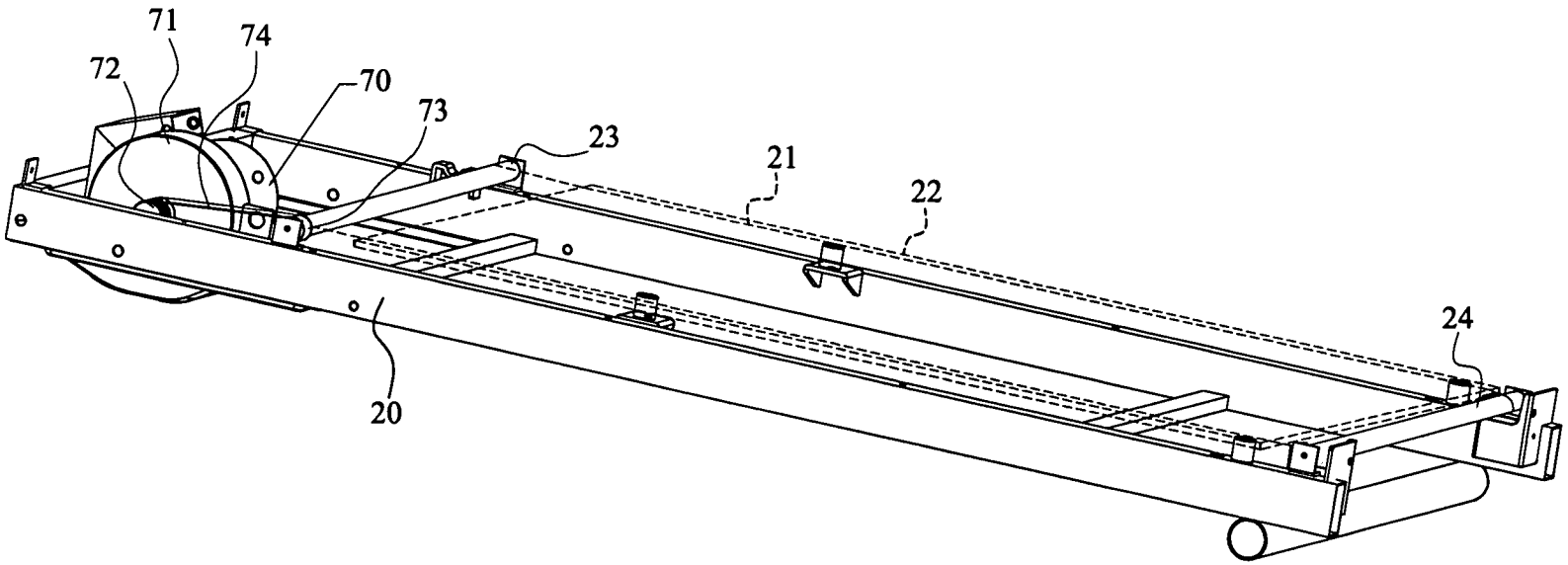
FIG. 2 is a perspective view of the frame of the present invention.
Figure 3:
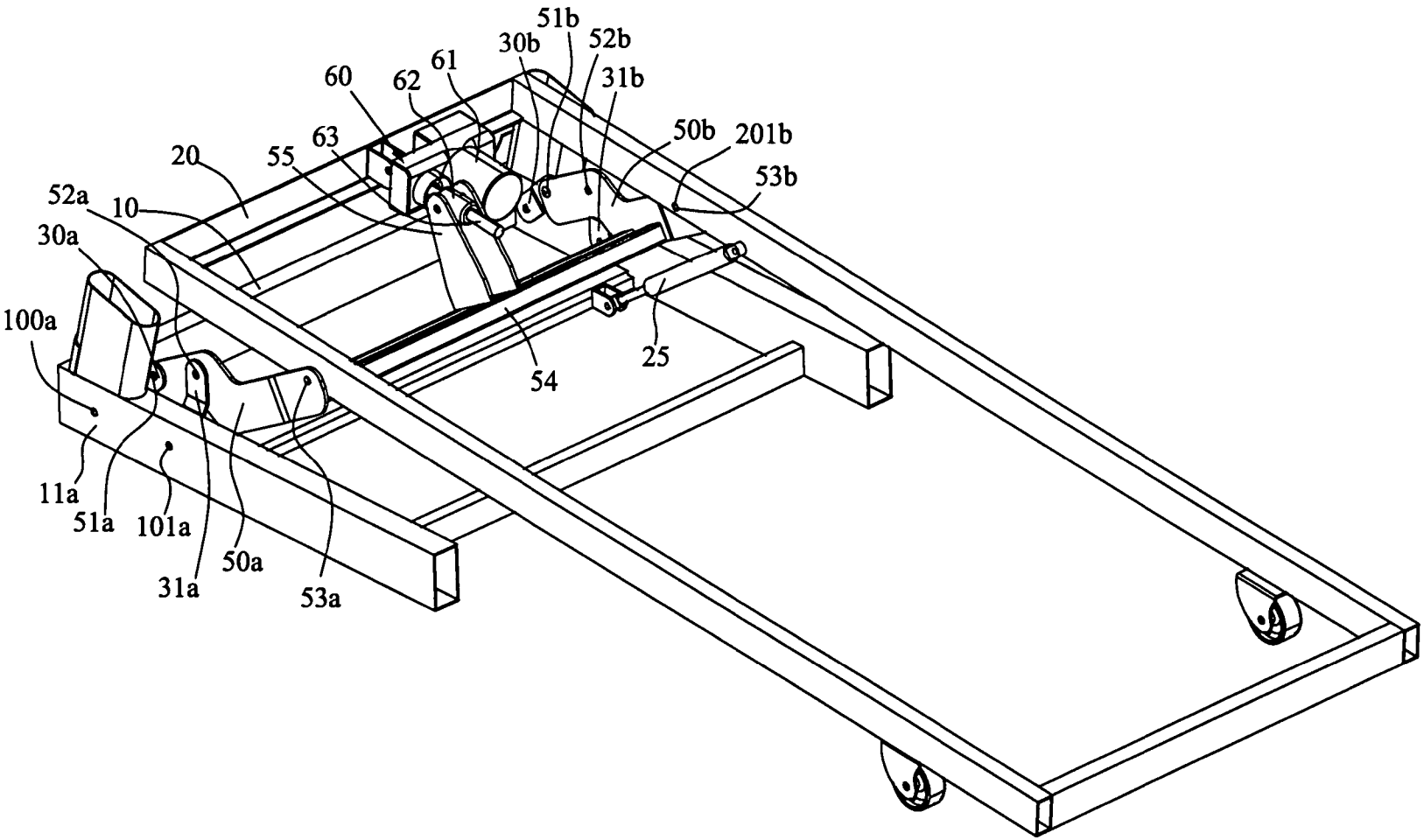
FIG. 3 is a perspective view of the treadmill of the present invention.

Referring to FIGS. 1 to 3, the treadmill of the present invention comprises a base 10 comprising two side rails 11*a*, 11*b* with two respective first pivotal points 100*a*, 100*b* and two respective second pivotal points 101*a*, 101*b*.

A frame 20 comprises two side rods 200*a*, 200*b* with two respective pivotal points 201*a*, 201*b*.

An endless running belt 21 is mounted to the frame 20 shown in FIG. 2.

Two first links 50*a*, 50*b* have two respective first pivotal points 51*a*, 51*b*, two respective second pivotal points 52*a*, 52*b* and two respective third pivotal points 53*a*, 53*b*. The two respective third pivotal points 53*a*, 53*b* are pivotally connected to the two respective pivotal points 201*a*, 201*b* on side rods 200*a*, 200*b* of the frame 20.

Two second links 30*a*, 30*b* have two respective ends. The two respective first ends of each of the two second 30*a*, 30*b* are respectively pivotally connected to two first pivotal points 100*a*, 100*b* on two side rails 11*a*, 11*b* of the base 10. The two respective second ends are respectively pivotally connected to the two respective first pivotal points 51*a*, 51*b* on each of the two first links 50*a*, 50*b*.

Two third links 31*a*, 31*b* have two respective ends. The two respective first ends of each of the two third links 31*a*, 31*b* are respectively pivotally connected to two respective second pivotal points 101*a*, 101*b* on each of the two side rails 11*a*, 11*b* of the base 10. Two respective second ends are respectively of each of the two third links 31*a*, 31*b* respectively pivotally connected to the two respective second pivotal points 52*a*, 52*b* on each of the two first links 50*a*, 50*b*.

A fixing rod 54 is fixed in-between the each of the two first links 50*a*, 50*b* with a connection 55 and an actuator 60, the actuator is composed of a motor 61 and a motor driven moving part 62 which is pivotally connected to the connection 55 of the fixing rod 54. Two respective groups of the first links 50*a*, 50*b*, the second links 30*a*, 30*b*, the third links 31*a*, 31*b* and the side rail 11*a*, 11*b* are structured as two pairs of four-bar-link mechanisms, which are working to bring up or down the first end of the frame, when the actuator 60 is driving the moving part 62, incline angle of the frame is changing, the purpose of adjusting the inclination of the frame is simply and efficiently achieved.

Referring to FIG. 1, one end of the actuator 60 is fixed on the frame and the other end is a rotary threaded rod 63 which threads through a moving part 62 so when the threaded rod 63 is rotated by the motor, the moving part 62 can move up and down along the threaded rod 63.

A pushing device 25 is connected between the base 10 and the frame 20 so as to pivot the frame 20 relative to the base 10. By the pushing device 25, the pivoting action of the frame 20 is easy.

Referring to FIG. 2, a support deck 22 is connected on the frame 20. Two pairs of rollers 23, 24 are connected on the two side rods of the frame 20 and located corresponding to two ends of the support deck 22. The endless running belt 21 reeves through the two pairs of rollers 23, 24 and the support deck 22 is located beneath an upper portion of the endless running belt 21 so as to support the load of the users.

A driving device 70 is located between the two side rods of the frame 20 so as to drive the roller 23 to drive the endless running belt 21.

The driving device 70 includes a motor 71, a first pulley 72 that is connected to the motor, a second pulley 73 that is connected to the roller 23 and a transmission belt 74 reeves through the first and second pulleys.

Referring to FIG. 3, two first links 50*a*, 50*b* push the frame 20 to a higher position so the users can run on the belt frame with a proper inclination. Referring to FIGS. 3 to 6, when the users want to change the inclination of the frame 20, the users can operate the motor 61 of the actuator 60 which will rotate the threaded rod 63 so that the moving part 62 can move along the threaded rod 63. Because the moving part 62 is pivotally connected to the connection 55, the power will transfer to the two first links 50*a*, 50*b* through the connection 55 and the fixing rod 54 so that the two first links 50*a*, 50*b* is pivoted to a different position relative to the base 10, further changes the position of the frame, so the inclination of the frame 20 is changing.

Figure 4:
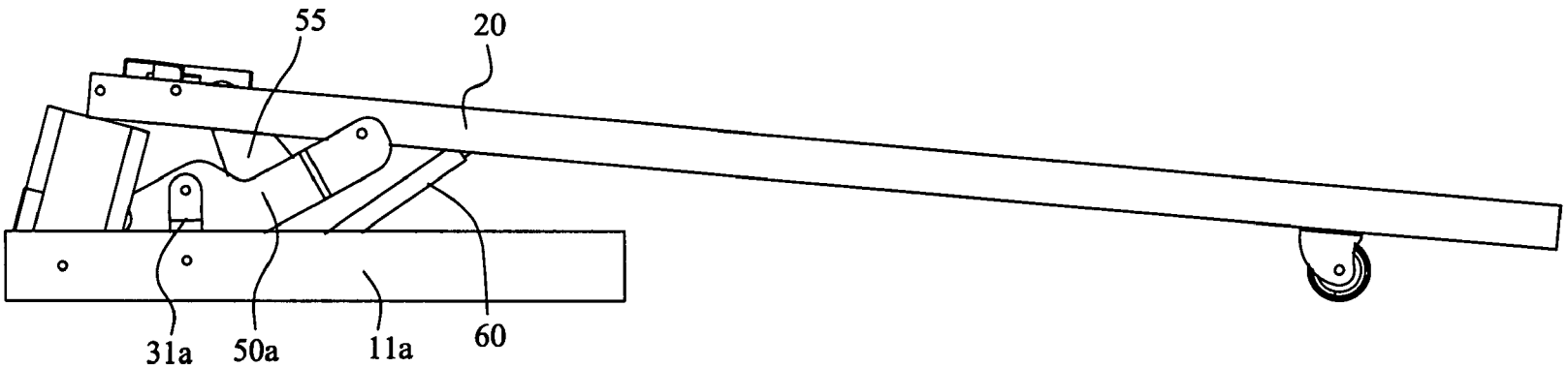
FIG. 4 is a side view of the frame in a higher inclination of the present invention.
Figure 6:
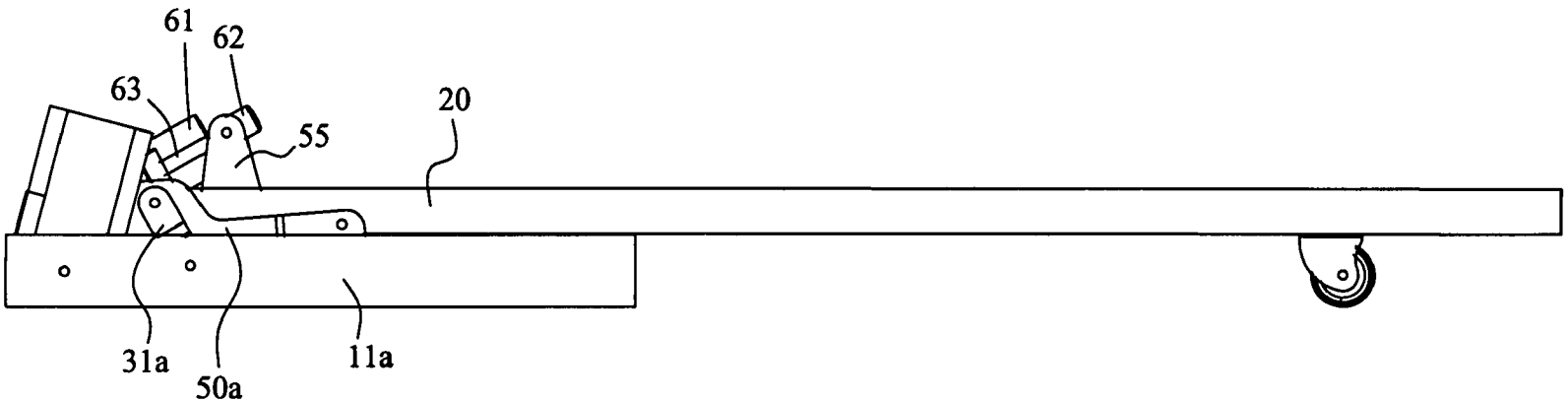
FIG. 6 is a side view of the frame in a lower inclination of the present invention.
Figure 5:
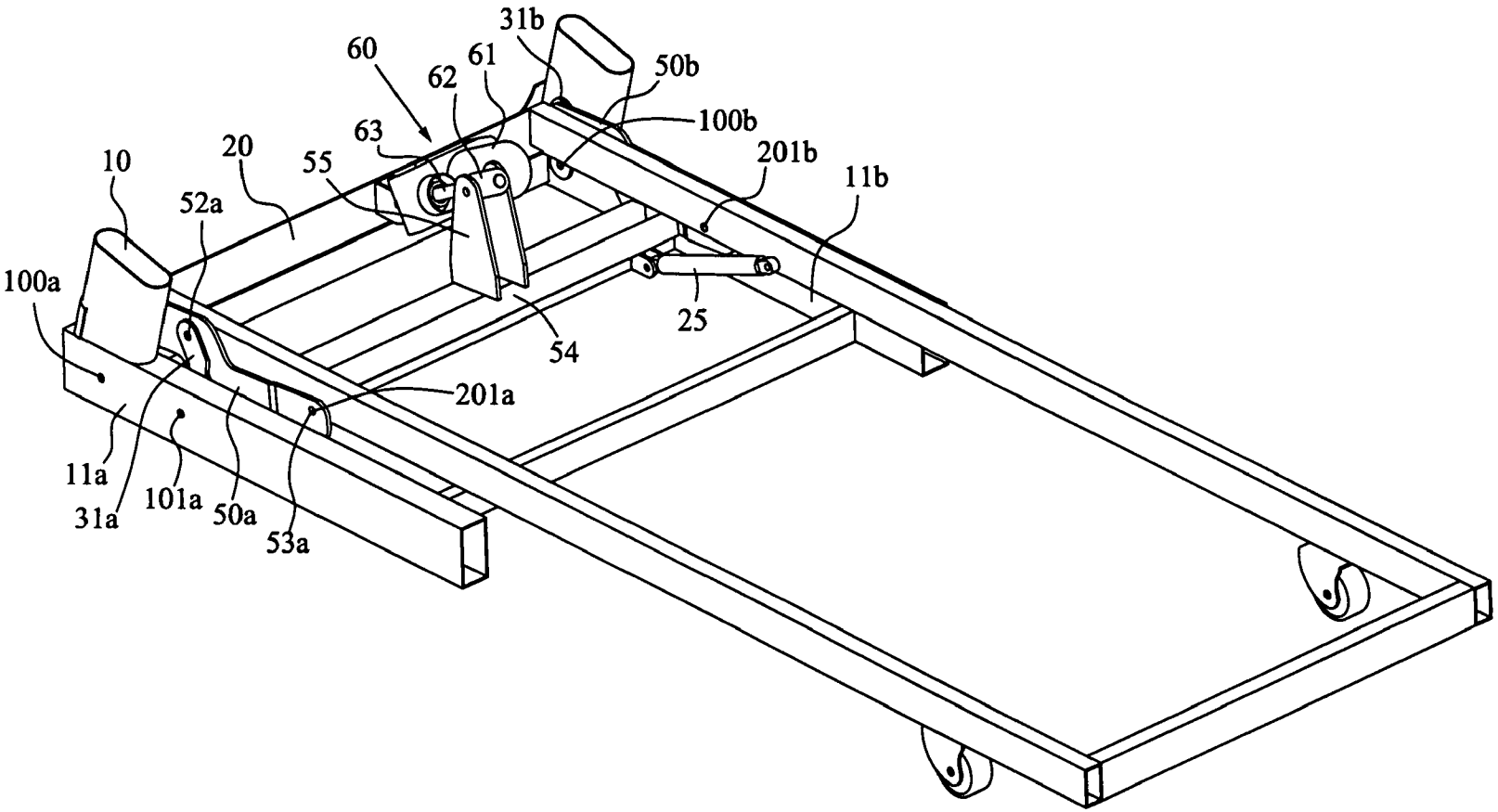
FIG. 5 is a solid view of the frame in a lower inclination of the present invention.
Figure 7:
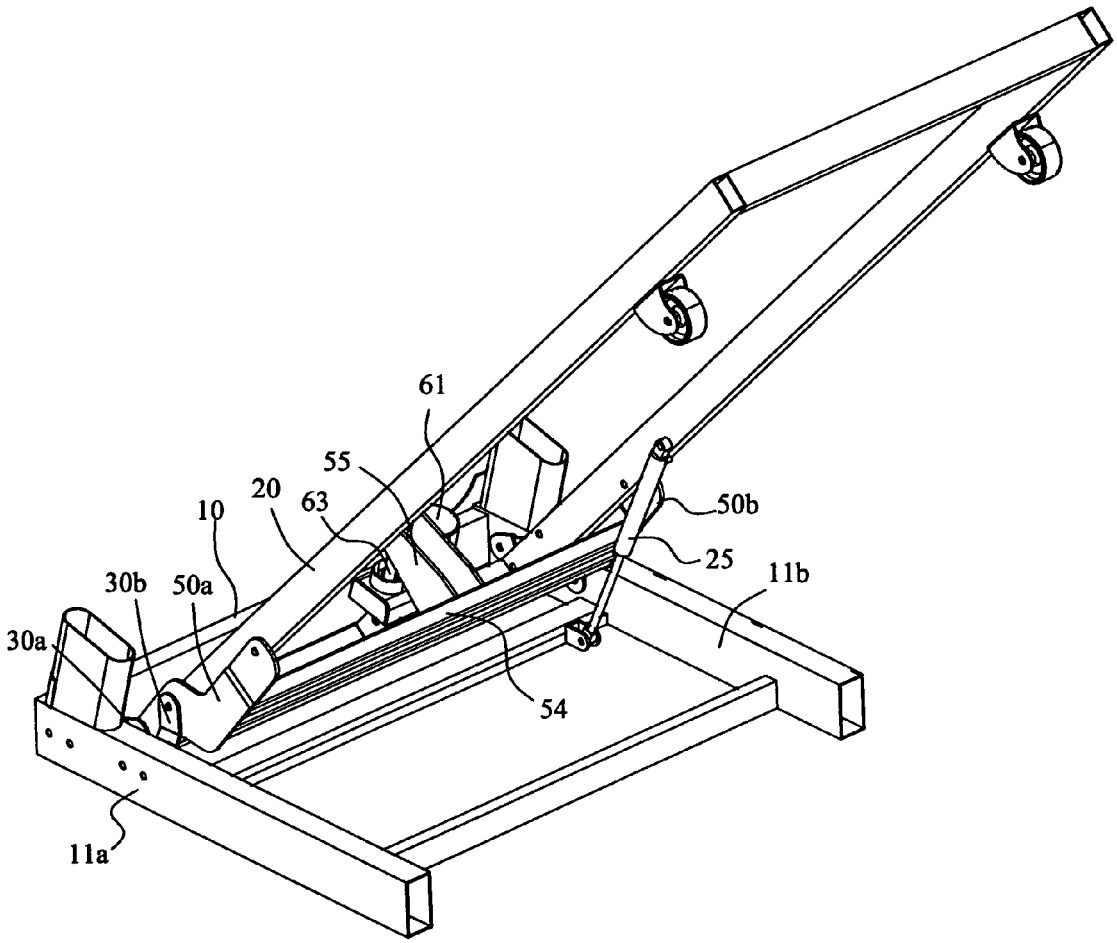
FIG. 7 is a solid view of folding the frame of the present invention.
Figure 8:
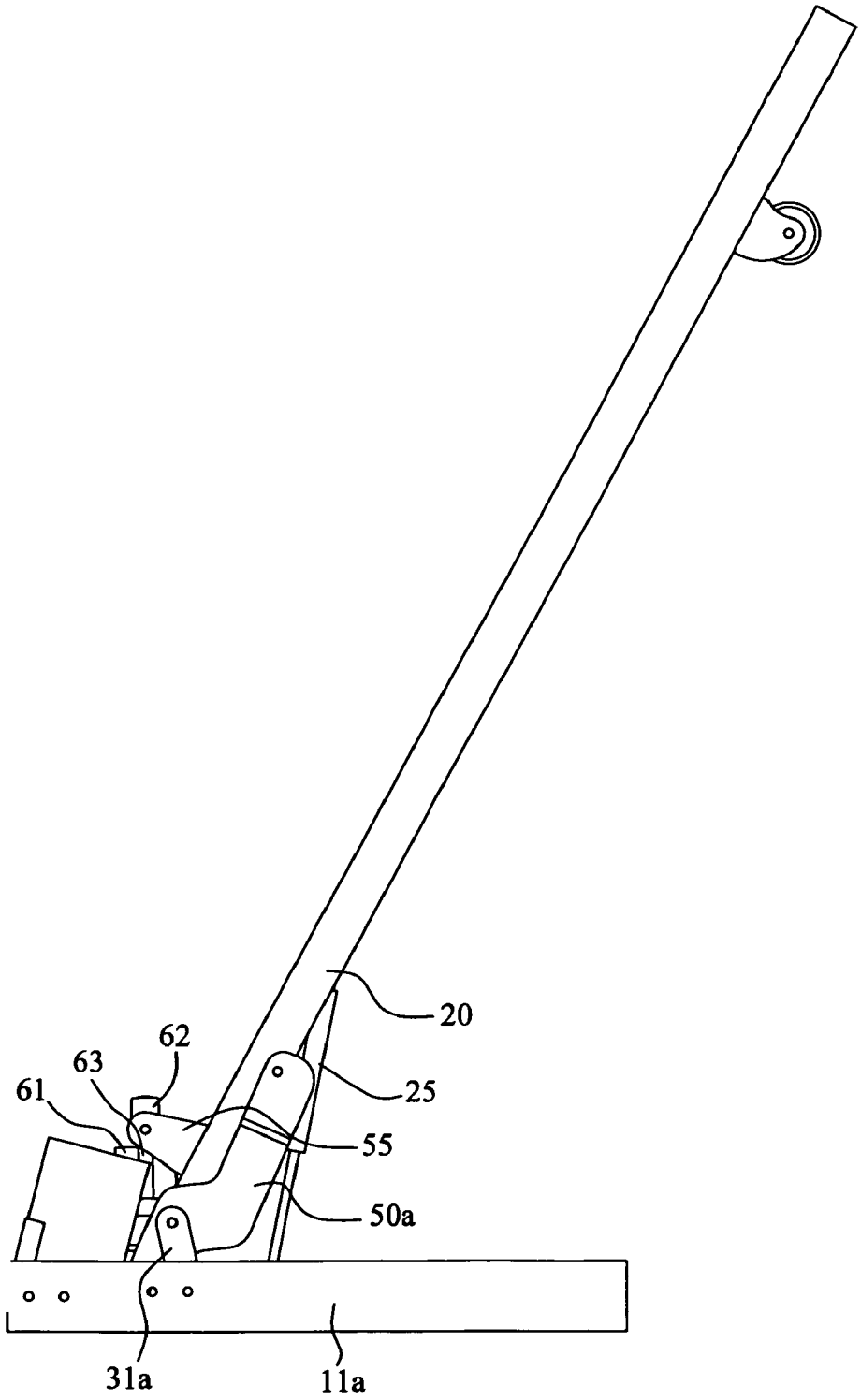
FIG. 8 is a side view of folding the frame of the present invention.
Figure 9:
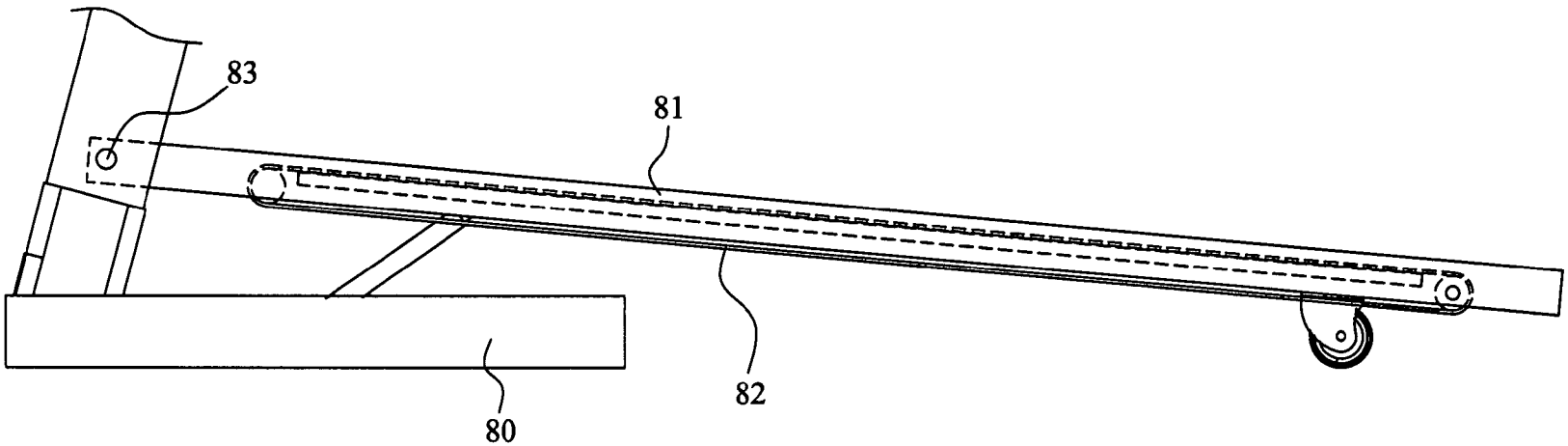
PRIOR ART FIG. 9
FIG. 9 is a side view of a prior art.

Referring to FIGS. 4, 7 and 8, when folding the frame 20, the users may lift the second end of the frame to pivot the frame 20 relative to the base 10 through the first links 50*a*, 50*b*, the second links 30*a*, 30*b* and the third links 31*a*, 31*b* till the frame 20 reaches its final position.

While we have shown and described the embodiment in accordance with the present invention, it should be clear to those skilled in the art that further embodiments may be made without departing from the scope of the present invention.

What is claimed is:

1. A treadmill comprises:

a base having two side rails, each of the two side rails having a first pivotal point and a second pivotal point;

a frame having two side rods; each of the two side rods having a pivotal point on the first end;

an endless running belt is mounted on the frame;

two first links, each of the first links having a first pivotal point, a second pivotal point and a third pivotal point, the third pivotal point respectively pivotally connected to the pivotal point on the each of the two side rods of the frame;

two second links, the first end of each of the two second links respectively pivotally connected to the first pivotal point of each of the two side rails of the base, the second end of each of the two second links respectively pivotally connected to the first pivotal point of each of the two first links;

two third links, the first end of each of the two third links respectively pivotally connected to the second pivotal point of each of the two side rails of the base, the second end of the two third links respectively pivotally connected to the second pivotal point of each of the two first links;

a fixing rod fixed in-between the two first links and having a connection; and an actuator comprising a motor and a motor driven moving part which is pivotally connected to the connection of the fixing rod.

2. The treadmill as claimed in claim 1, wherein the actuator is connected to the frame.

3. The treadmill as claimed in claim 1, wherein the output of the actuator is a rotary threaded rod that is threaded to a moving part so that when the motor rotates the threaded rod, the moving part can move along the threaded rod.

4. The treadmill as claimed in claim 1, wherein a pushing device is connected between the base and the frame so as to pivot the frame relative to the base.

5. The treadmill as claimed in claim 1, wherein a support deck is connected on the frame and two pairs of rollers are connected on the two side rods of the frame and located corresponding to two ends of the support deck, the endless running belt reeves through the two pairs of rollers and the support deck located beneath an upper portion of the endless running belt.

6. The treadmill as claimed in claim 5, wherein a driving device connects to one of the rollers so as to drive the endless running belt.

7. The treadmill as claimed in claim 6, wherein the driving device includes a motor, a first pulley that is connected to the motor, a second pulley that is connected to one of the rollers and a transmission belt that reeves through the first and second pulleys.

* * * * *